US007679290B2

(12) United States Patent
Utsubo et al.

(10) Patent No.: US 7,679,290 B2
(45) Date of Patent: Mar. 16, 2010

(54) METAL HALIDE LAMP WITH LIGHT-TRANSMITTING CERAMIC ARC TUBE

(75) Inventors: Atsushi Utsubo, Hirakata (JP); Makoto Horiuchi, Sakurai (JP); Makoto Kai, Katano (JP); Hiroshi Nohara, Nishinomiya (JP)

(73) Assignee: Panasonic Corporation, Kadoma (JP)

( * ) Notice: Subject to any disclaimer, the term of this patent is extended or adjusted under 35 U.S.C. 154(b) by 229 days.

(21) Appl. No.: 11/291,628

(22) Filed: Dec. 1, 2005

(65) Prior Publication Data

US 2006/0082313 A1 Apr. 20, 2006

(30) Foreign Application Priority Data

Jun. 16, 2003 (JP) ..... 2003-170508

(51) Int. Cl.
*H01J 17/04* (2006.01)
*H01J 61/20* (2006.01)
*H01J 17/20* (2006.01)

(52) U.S. Cl. ..... 313/637; 313/621; 313/641; 501/152

(58) Field of Classification Search ..... 313/623
See application file for complete search history.

(56) References Cited

U.S. PATENT DOCUMENTS 4,808,881 A 2/1989 Kariya et al.
5,055,735 A 10/1991 De Jong et al.
5,451,838 A * 9/1995 Kawai ..... 313/638
6,031,332 A 2/2000 Wijenberg et al.
6,107,742 A * 8/2000 Seki et al. ..... 313/639
6,208,070 B1 3/2001 Sugimoto et al.
6,300,729 B1 10/2001 Keijser et al.

(Continued)

FOREIGN PATENT DOCUMENTS

EP 1 180 786 A2 2/2002

(Continued)

OTHER PUBLICATIONS

International Search Report for corresponding Application No. PCT/JP2004/005652 mailed Aug. 17, 2004.

(Continued)

*Primary Examiner*—Sikha Roy
*Assistant Examiner*—Tracie Green
(74) *Attorney, Agent, or Firm*—Renner, Otto, Boisselle & Sklar, LLP

(57) ABSTRACT

A metal halide lamp according to the present invention includes: a main tube (6) made of a light-transmitting ceramic and forming a part of an arc tube; a first thin tube (7*a*) coupled to a first end of the main tube (6); a second thin tube (7*b*) coupled to a second end of the main tube (6); a pair of electrodes (5*a*, 5*b*), which are inserted into the first and second thin tubes (7*a*, 7*b*), respectively, such that the far ends thereof face each other inside the main tube (1); and a first metal halide enclosed in the arc tube. A second metal halide, which has a lower vapor pressure than that of the first metal halide, is further enclosed in the arc tube. And the main tube (6) has portions, of which the inside diameter decreases monotonically toward the ends.

14 Claims, 5 Drawing Sheets

U.S. PATENT DOCUMENTS

| | | | | |
|---|---|---|---|---|
| 6,404,548 | B1 * | 6/2002 | Tatsuki et al. | 359/449 |
| 6,469,446 | B1 | 10/2002 | Stockwald | |
| 6,545,413 | B1 * | 4/2003 | Takahashi et al. | 313/620 |
| 6,731,068 | B2 * | 5/2004 | Dakin et al. | 313/640 |
| 6,737,808 | B1 | 5/2004 | Hendricx et al. | |
| 6,819,050 | B1 * | 11/2004 | Zhu et al. | 313/639 |
| 2002/0101160 | A1 * | 8/2002 | Kakisaka et al. | 313/623 |
| 2003/0020408 | A1 | 1/2003 | Higashi et al. | |
| 2003/0025453 | A1 * | 2/2003 | Kakisaka et al. | 313/621 |
| 2003/0209986 | A1 * | 11/2003 | Ishigami et al. | 313/641 |

FOREIGN PATENT DOCUMENTS

| | | | |
|---|---|---|---|
| JP | 63-160148 | | 7/1988 |
| JP | 9-204902 | | 8/1997 |
| JP | 10-050262 | | 2/1998 |
| JP | 10-134765 | | 5/1998 |
| JP | 10-283996 | | 10/1998 |
| JP | 10-326596 | | 12/1998 |
| JP | 11-135070 | | 5/1999 |
| JP | 11-233064 | | 8/1999 |
| JP | 2001-345064 | | 12/2001 |
| WO | WO 00/67294 | * | 11/2000 |

OTHER PUBLICATIONS

Office Action dated Sep. 12, 2008 issued for the corresponding Chinese Patent Application No. 200480015950.6 and English translation thereof.

* cited by examiner

METAL HALIDE LAMP WITH LIGHT-TRANSMITTING CERAMIC ARC TUBE

This is a continuation of International Application PCT/JP2004/005652, with an international filing date of Apr. 20, 2004.

FIELD OF THE INVENTION

The present invention relates to a metal halide lamp with an arc tube made of a light-transmitting ceramic.

DESCRIPTION OF THE RELATED ART

In the past, the arc tube of a metal halide lamp was made of quartz glass. Recently, however, an arc tube made of a light-transmitting ceramic, which has higher thermal resistance, higher shape stability and higher resistibility to halide than quartz, has been adopted extensively.

In such a metal halide lamp, it is effective to enclose a rare-earth halide such as dysprosium halide in its arc tube to produce white radiation with an even higher color rendering index (see page 2 of Japanese Patent Application Laid-Open Publication No. 10-134765, for example). A rare-earth halide produces emission continuously in the visible range as not only atomic emission but also molecular emission, and therefore, can be used effectively as a material to be enclosed in a white light source.

However, once enclosed in the arc tube, the rare-earth halide easily reacts with, and erodes, a sealing material of $Al_2O_3$, $Dy_2O_3$ or $SiO_2$ (e.g., glass frit) while the lamp is being ON. When such an erosion reaction of the sealing material proceeds, leakage will soon produce through the sealing portions, thus posing a major obstacle to extending the life of such a metal halide lamp.

This problem will be discussed more fully with reference to FIGS. 1 and 2.

First, referring to FIG. 1, illustrated is a cross-sectional view of an arc tube for use in a conventional metal halide lamp. As shown in FIG. 1, the arc tube includes a main tube 6 made of a light-transmitting ceramic such as alumina and thin tubes 7*a* and 7*b* coupled to the main tube 6.

The main tube 6 has a substantially cylindrical shape and the thin tubes 7*a* and 7*b* extend in the axial direction from the flat end faces thereof. The thin tubes 7*a* and 7*b* have an elongated cylindrical shape. Leads 9*a* and 9*b*, including a pair of electrodes 5*a* and 5*b* at their far ends, are inserted into their associated thin tubes 7*a* and 7*b*. The leads 9*a* and 9*b* with the electrodes 5*a* and 5*b* will sometimes be referred to herein as "electrode leads" collectively. The leads 9*a* and 9*b* inserted into the thin tubes 7*a* and 7*b* are fixed onto the thin tubes 7*a* and 7*b* at sealing portions 8*a* and 8*b* thereof. These leads 9*a* and 9*b* may be fixed with sealing materials 10*a* and 10*b* made of the glass frit mentioned above.

To make a metal halide lamp, including an arc tube of a light-transmitting ceramic, radiate white light, 10 to 60 mass % of a rare-earth halide needs to be enclosed in the arc tube. However, if the rare-earth halide were enclosed in the arc tube at such a concentration, then not all of the rare-earth halide could vaporize while the lamp is ON. Instead, some of the rare-earth halide would enter the liquid phase and eventually flow into the thin tubes, of which the temperature is the coolest in the lamp. In that case, the glass frit that seals the thin tubes up would react with, and be eroded by, the rare-earth halide that has entered the thin tubes.

Next, the sealing structure of the sealing portion 8*a* will be described with reference to FIG. 2, which is an enlarged cross-sectional view of the sealing structure at one end of the thin tube 7*a*. A similar sealing structure is also provided at one end of the other thin tube 7*b*.

As can be seen from FIG. 2, the gap between the thin tube 7*a* and the lead 9*a* is filled with the sealing material 10*a*, thereby shutting the inside of the arc tube 1 off from the outside. When a rare-earth halide (such as $DyI_3$), preferably used in a metal halide lamp, has diffused from the main tube to reach the surface of the sealing material 10*a*, the rare-earth halide will enter the liquid phase on the surface of the sealing material 10*a* and react with, and be eroded by, the sealing material 10*a*. As a result, sealing leakage will soon arise to possibly shorten the lamp life significantly.

To overcome such a problem, Japanese Patent Application Laid-Open Publication No. 63-160148 (see page 2) discloses a metal halide lamp in which an electrical insulating layer is provided on the surface of the sealing material. For the same purpose, Japanese Patent Application Laid-Open Publication No. 9-204902 (see page 2) teaches cutting a groove on an electrical conductor and Japanese Patent Application Laid-Open Publication No. 10-50262 (see page 2) teaches using a sealing material that is not eroded so easily. However, the present inventors discovered via experiments that according to the conventional techniques disclosed in these patent documents, the erosion of the sealing material by the rare-earth halide enclosed could be minimized but the metal halide lamp with such a complicated structure was not easy to fabricate and was likely to cause cracks when the lamp was sealed up. In order to overcome the problems described above, a primary object of the present invention is to provide a novel metal halide lamp that can prevent the sealing material from being eroded by a rare-earth halide, enclosed in an arc tube of a light-transmitting ceramic, by using a simple structure.

SUMMARY OF THE INVENTION

A metal halide lamp according to the present invention includes an arc tube and a first metal halide that is enclosed in the arc tube. The first metal halide is a halide of at least one metal selected from the group consisting of dysprosium, holmium and thulium. The arc tube includes: a main tube made of a light-transmitting ceramic; a first thin tube coupled to a first end of the main tube; a second thin tube coupled to a second end of the main tube; and a pair of electrode leads, which are inserted into the first and second thin tubes, respectively, such that the far ends of the leads face each other inside the main tube. The respective ends of the first and second thin tubes are sealed with a sealing material. At least a portion of the surface of the sealing material communicates with the inside of the main tube through a gap created between the inner wall of the thin tubes and the surface of the electrode leads. A second metal halide, which has a lower vapor pressure than that of the first metal halide at a temperature at sealing portions while the lamp is ON, is enclosed in the arc tube. And the arc tube has portions of which the inside diameter decreases monotonically toward the ends.

In one preferred embodiment, the vapor pressure of the second metal halide is one-tenth or less of that of the first metal halide.

In another preferred embodiment, the sealing material is made of glass.

In still another preferred embodiment, the second metal halide is a halide of at least one metal selected from the group consisting of calcium, strontium, barium, lanthanum, samarium and europium.

In yet another preferred embodiment, the amount of the second metal halide enclosed falls within the range of 0.05 $mg/cm^3$ to 7.5 $mg/cm^3$.

In yet another preferred embodiment, the ratio of the amount of the second metal halide enclosed to that of the first metal halide enclosed is represented by a mole fraction of 0.5 to 8.

In yet another preferred embodiment, the light-transmitting ceramic is alumina.

In yet another preferred embodiment, the arc tube and the first and second thin tubes have been molded together.

In yet another preferred embodiment, the arc tube has a hollow ellipsoidal shape.

In yet another preferred embodiment, the metal halide lamp further includes an outer tube to include the arc tube in its inner space, and a light-transmitting protective cylinder for housing the arc tube in the inner space of the outer tube. The thin tubes are partially exposed outside of the protective cylinder.

A lamp module according to the present invention includes a metal halide lamp according to any of the preferred embodiments described above, and a reflective mirror for projecting light, radiated from the metal halide lamp, in a predetermined direction.

A display device according to the present invention includes a metal halide lamp according to any of the preferred embodiments described above, and a display panel for presenting an image thereon by modulating the light, radiated from the metal halide lamp, both temporally and spatially.

DETAILED DESCRIPTION OF PREFERRED EMBODIMENTS

Figure 1:
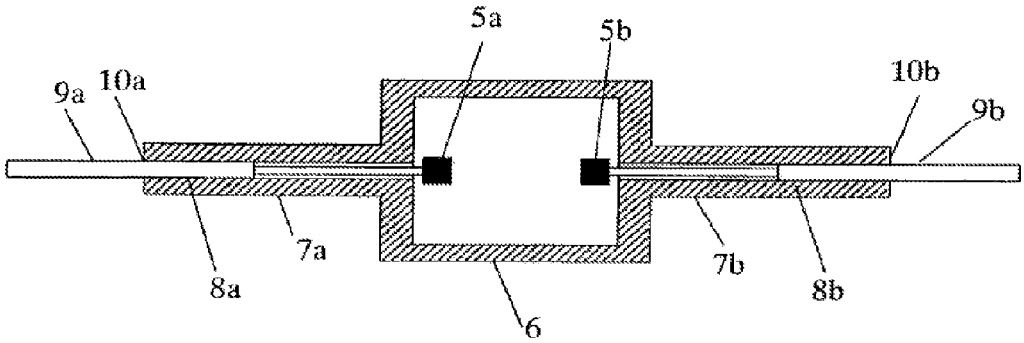
FIG. 1 CONVENTIONAL ART
FIG. 1 is a cross-sectional view illustrating a configuration for a conventional arc tube for use in a metal halide lamp.
Figure 2:
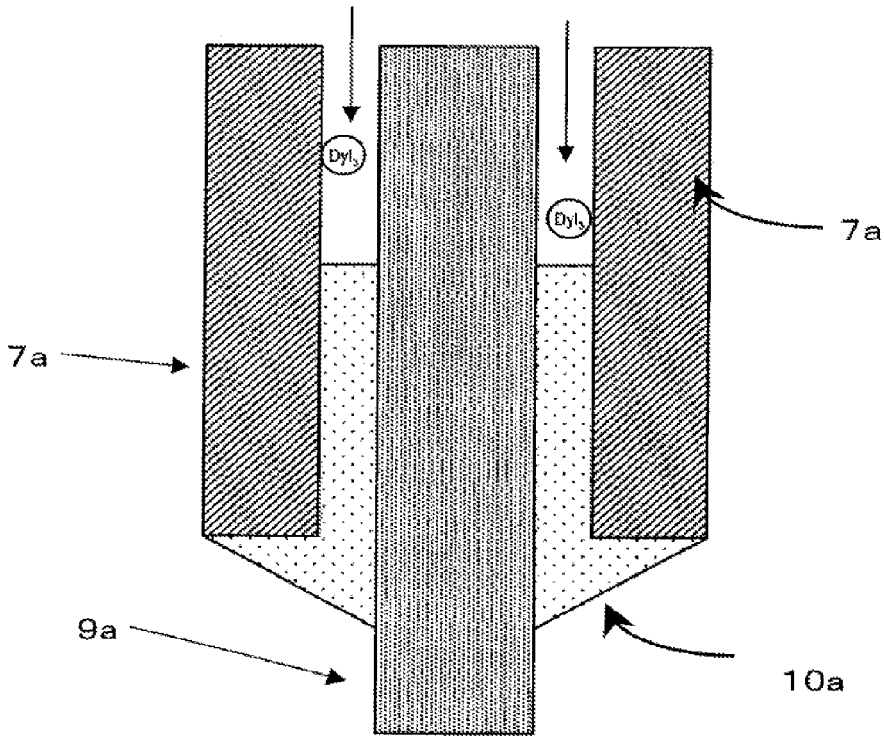
FIG. 2 CONVENTIONAL ART
FIG. 2 is a cross-sectional view schematically illustrating the sealing structure of the arc tube shown in FIG. 1.

Hereinafter, preferred embodiments of the present invention will be described with reference to the accompanying drawings.

In a metal halide lamp according to the present invention, a metal halide, having a lower vapor pressure than a rare-earth halide, is enclosed in an arc tube to prevent the rare-earth halide from eroding the sealing material. In the following description, a metal halide with a relatively high vapor pressure (more specifically, a halide of at least one metal selected from the group consisting of dysprosium, holmium and thulium) will be referred to herein as a "first metal halide", and another metal halide, having a lower vapor pressure than the first metal halide, will be referred to herein as a "second metal halide". In a preferred embodiment, the second metal halide is a halide of at least one metal selected from the group consisting of calcium, strontium, barium, lanthanum, samarium and europium.

As used herein, the "vapor pressure" refers to a vapor pressure value to be measured at the temperature of the sealing portions while the lamp is ON.

In the arc tube, most of the second metal halide flows into the thin tubes at the lower temperature and enters the liquid phase, and therefore, can dilute the first metal halide on the surface of the sealing material (i.e., a metal halide having a property of eroding the sealing portions easily) and can check the unwanted reaction. Such a material with a low vapor pressure is useful because the color of the resultant light will be hardly affected even if that material is enclosed a lot. To achieve this effect of the second metal halide fully, the vapor pressure of the second metal halide is preferably one-tenth or less of that of the first metal halide.

As a result of researches, the present inventors sensed the problem that if a cylindrical arc tube, used extensively as a ceramic arc tube, was adopted, then most of the second metal halide with the relatively low vapor pressure remained in the liquid phase in the main tube and could not minimize the unwanted reaction effectively. Thus, to overcome such a problem, an arc tube with tapered portions is adopted according to the present invention so as to make the second metal halide in the gas phase enter the thin tubes.

It should be noted that if the lamp is designed such that the thin tubes, to which electrode leads are inserted, are partially exposed outside of a light-transmitting protective cylinder to be provided within an outer tube, then the temperature of the exposed sealing portions can be decreased. In that case, an even greater majority of the second metal halide with the lower vapor pressure will condense around the surface of the sealing material and dilute the first metal halide. In addition, the temperature will further drop on the surface of the sealing material, thus minimizing the unwanted reaction and erosion effectively, too.

Hereinafter, specific preferred embodiments of a metal halide lamp according to the present invention will be described in further detail with reference to the accompanying drawings.

Embodiments

Figure 3:
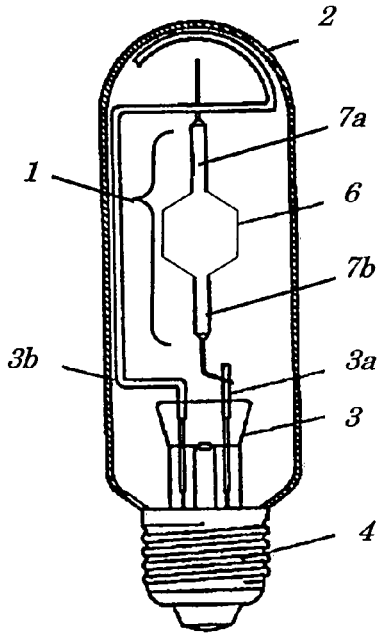
FIG. 3 is a front view illustrating a preferred embodiment of a metal halide lamp according to the present invention.
Figure 4:
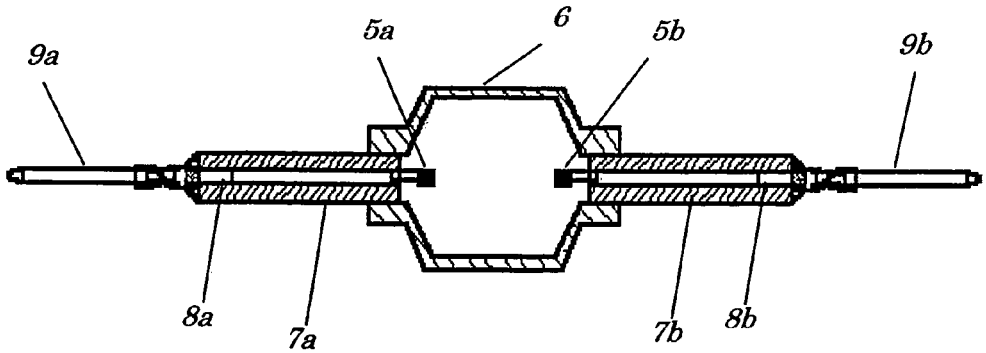
FIG. 4 is a cross-sectional view illustrating the arc tube of the preferred embodiment shown in FIG. 3.

A metal halide lamp according to a specific preferred embodiment of the present invention will be described with reference to FIGS. 3 and 4. FIG. 3 is a cross-sectional view illustrating a schematic configuration for a metal halide lamp according to this preferred embodiment, including an arc tube 1 of a ceramic. FIG. 4 is an enlarged cross-sectional view of the arc tube 1.

First, referring to FIG. 3, illustrated is a metal halide lamp according to this preferred embodiment, which is designed so as to produce emission at an operating power of 150 W. The arc tube 1 made of a light-transmitting ceramic is housed in an outer tube 2, which is sealed up with a stem 3. More specifically, the arc tube 1 is fixed onto metal wires 3*a* and 3*b*, extending from the stem 3, and is supported by the metal wires 3*a* and 3*b* substantially at the center of the outer tube 2. The metal wires 3*a* and 3*b* are electrically connected to a base 4, which is provided at one end of the outer tube 2, so as to function as not only members for supporting the arc tube 1 but also conductive members for supplying a required amount of current to the arc tube 1.

Next, the configuration of the arc tube 1 will be described in more detail with reference to FIG. 4.

This arc tube 1 includes a main tube 6 made of a light-transmitting ceramic and thin tubes 7*a* and 7*b* coupled to the main tube 6.

The main tube 6 includes a first type of cylindrical portion with an outside diameter of 12.0 mm and tapered portions, of which the outside and inside diameters decrease monotonically toward the ends. Parts of the tapered portions of the main tube 6 with the smallest inside diameter are connected to a second type of cylindrical portions, into which the respective ends of the thin tubes 7*a* and 7*b* are inserted.

Each of the thin tubes 7*a* and 7*b* has an elongated cylindrical shape with an outside diameter of 3.2 mm and an inside diameter of 1.025 mm. In this preferred embodiment, not only the main tube 6 but also the thin tubes 7*a* and 7*b* are made of alumina, which is a light-transmitting ceramic.

Leads 9*a* and 9*b*, including a pair of electrodes 5*a* and 5*b* at their far ends (i.e., electrode leads), are inserted into the thin tubes 7*a* and 7*b*, respectively. The leads 9*a* and 9*b* are made of niobium with a diameter of 0.9 mm. The leads 9*a* and 9*b* are connected to the metal wires 3*a* and 3*b* shown in FIG. 3 to receive externally supplied electrical power, which is needed to operate the lamp, through the base 4. In operating the lamp, a voltage is applied between the electrodes 5*a* and 5*b* by way of the leads 9*a* and 9*b*, thereby causing an electrical discharge of the gas enclosed in the arc tube 1 and producing an emission.

The leads 9*a* and 9*b* inserted into the thin tubes 7*a* and 7*b* are fixed onto the thin tubes 7*a* and 7*b* at their sealing portions 8*a* and 8*b*, respectively. These leads 9*a* and 9*b* are fixed with a sealing material of glass frit. And the gap between the thin tubes 7*a* and 7*b* and the leads 9*a* and 9*b* is filled with a sealing material.

Inside the main tube 6, the electrodes 5*a* and 5*b* at the far ends of the leads 9*a* and 9*b* face each other with a predetermined space provided between them. This electrode spacing is fixed after the insertion depth of the leads 8*a* and 9*b* has been adjusted. The illustration of the sealing material is omitted in FIG. 4.

In the arc tube 1 with such a configuration, not only a predetermined amount of mercury and argon serving as a start rare gas but also a second metal halide are enclosed. As this second metal halide, a material having a lower vapor pressure in the arc tube 1 than that of the first metal halide is used. Specifically, the second metal halide is preferably a halide (e.g., a bromide) of at least one metal selected from the group consisting of calcium, strontium, barium, lanthanum, samarium and europium. The amount of the second metal halide enclosed preferably falls within the range of 0.05 $mg/m^3$ to 7.5 $mg/m^3$. A rare gas such as neon, krypton, and/or xenon may also be used instead of, or in addition to, argon.

Next, it will be described with reference to the accompanying drawings how the second metal halide works.

Figure 5A:
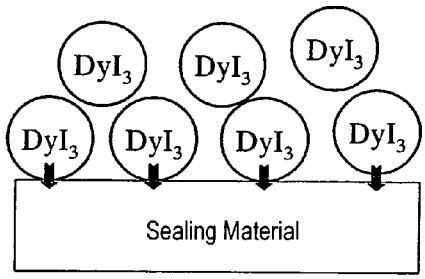
FIG. 5A and FIG. 5B are schematic representations illustrating the effects of the second metal halide.
Figure 5B:
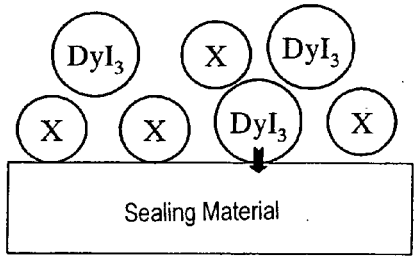

FIG. 5A schematically illustrates how dysprosium iodide ($DyI_3$), which is a typical first metal halide, deposits on the surface of a sealing material. Meanwhile, FIG. 5B schematically illustrates how the surface of the sealing material is like when a second metal halide (X), having a lower vapor pressure than dysprosium iodide, is enclosed in the arc tube. The second metal halide (X) has a relatively low vapor pressure, and therefore, easily enters the liquid phase on the surface of the sealing material, where the temperature is the lowest. If the second metal halide in the liquid phase is present on the surface of the sealing material, then the first metal halide such as dysprosium iodide does not easily deposit on the surface of the sealing material and is diluted on that surface as a result. Thus, the configuration of this preferred embodiment can prevent the sealing material from being eroded or deteriorated and can extend the lamp life significantly.

Figure 6:
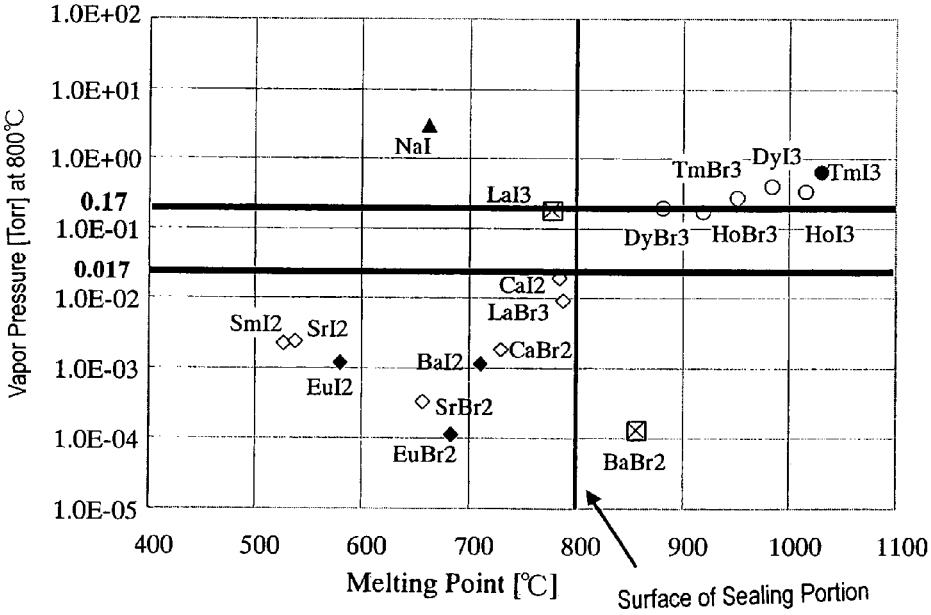
FIG. 6 is a graph showing the vapor pressures and melting points of first and second metal halides.

The second metal halide to be preferably enclosed in the arc tube preferably has a vapor pressure that is lower than that of the first metal halide, also enclosed in the arc tube, by at least one order of magnitude. That is to say, the vapor pressure of the second metal halide is preferably one-tenth or less of that of the first metal halide. FIG. 6 shows the respective vapor pressures (measured at 800° C.) and melting points of various metal halides of the second type. It is because the sealing portions have a temperature of about 800° C. (i.e., the temperature of the coolest part) while the lamp of this preferred embodiment is operating that the vapor pressures at 800° C. are shown in FIG. 6. In addition, the vapor pressures of $DyI_3$, $TmI_3$ and $HoI_3$, which are three major metal halides of the first type, are also indicated by the open circles in FIG. 6 just for reference.

As can be seen from FIG. 6, the respective vapor pressures of these metal halides of the first type as measured at 800° C. (which is equal to the temperature of the sealing portions while the lamp is ON) are 0.17 Torr or more. Since the vapor pressure of the second metal halide is preferably one-tenth or less of that of the first metal halide, a metal halide having a vapor pressure of 0.017 Torr or less at 800° C. is preferably used. The results of experiments the present inventors carried out revealed that particularly beneficial effects were achieved when $CaBr_2$ was used among various metal halides of the second type. Optionally, if it has a lower vapor pressure than that of the first metal halide to be enclosed in the arc tube 1, a halide of at least one metal selected from the group consisting of calcium, strontium, barium, lanthanum, samarium and europium may be used either by itself or in combination. Next, it will be described with reference to FIGS. 7A, 7B and 8 exactly how the arc tube 1 with the configuration of this preferred embodiment prevents the sealing material from deteriorating.

Figure 7A:
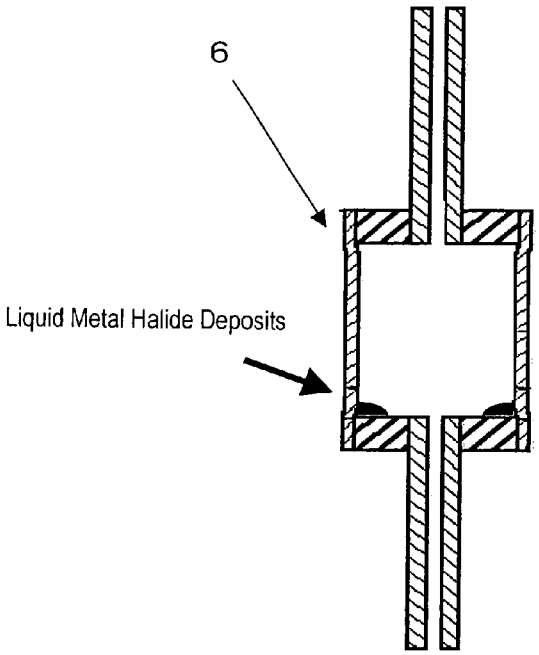
FIG. 7A is a cross-sectional view illustrating a conventional arc tube in which the second metal halide has entered the liquid phase.
Figure 7B:
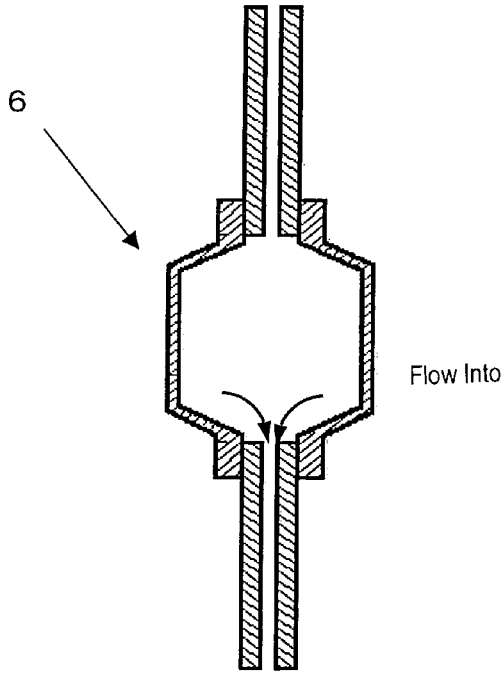
FIG. 7B is a cross-sectional view illustrating an arc tube according to a preferred embodiment of the present invention in which the second metal halide in the gas phase enters the thin tubes.

FIG. 7A illustrates a situation where a second metal halide with a low vapor pressure is enclosed in a main tube with a conventional structure including no tapered portions as a comparative example. On the other hand, FIG. 7B illustrates a situation where the second metal halide is enclosed in a main tube with tapered portions as in this preferred embodiment. In the main tube 6 shown in FIG. 7A, the temperature of the main tube 6 decreases at the corners, where the second metal halide easily enters the liquid phase. If the second metal halide in the liquid phase is produced in the main tube 6, then the first metal halide cannot be diluted sufficiently on the surface of the sealing material and the deterioration of the sealing portions cannot be prevented effectively.

Meanwhile, according to the configuration of this preferred embodiment, the main tube 6 has the tapered portions as shown in FIG. 7B and the temperature inside the main tube 6 does not decrease to the point that the second metal halide enters the liquid phase inside the main tube 6. Instead, the second metal halide in the gas phase is likely to flow along the tapered portions into the thin tubes. As a result, the amount of the second metal halide reaching the surface of the sealing material increases. Thus, by providing tapered portions such as those shown in FIG. 7B, the temperature of the coolest part of the main tube can be increased by about 50° C. as compared to the situation where no tapers are provided.

Figure 8:
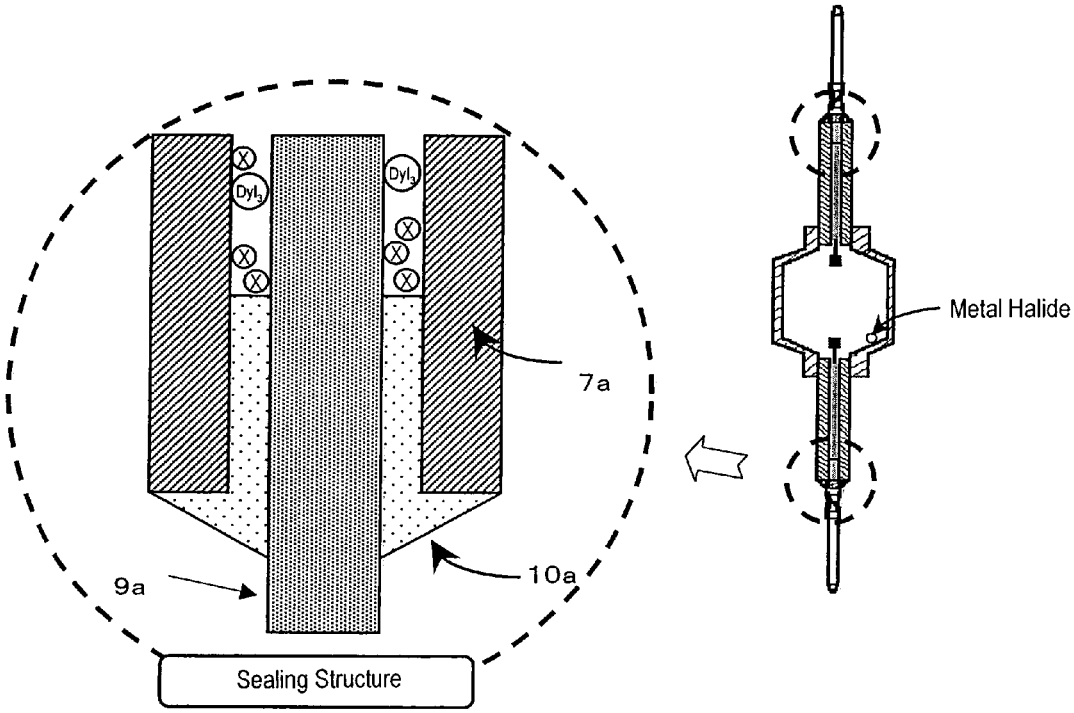
FIG. 8 is a cross-sectional view schematically illustrating how the second metal halide that has flowed into the thin tube dilutes the first metal halide.

FIG. 8 schematically illustrates how a good amount of the second metal halide (X) that has reached the surface of the sealing material 10*a* dilutes the first metal halide such as $DyI_3$ and protects the sealing material 10*a*. According to this preferred embodiment, the second metal halide (X) that has entered the liquid phase on the surface of the sealing material 10*a* or 10*b* can dilute the first metal halide sufficiently, thus preventing the sealing leakage effectively.

To achieve these effects, the lamp preferably has such a shape that the heat generated by the electrical discharge can be supplied to the entire main tube 6 sufficiently uniformly. In the conventional structure shown in FIG. 7A, the heat generated by the electrical discharge is not sufficiently supplied to the corners of the main tube 6, where the temperature is likely to drop compared to the other portions. And if there are such portions with the decreased temperature, then the second metal halide with the lower vapor pressure easily enters the liquid phase inside the main tube 6 and the sealing material cannot be protected sufficiently anymore.

Figure 9:
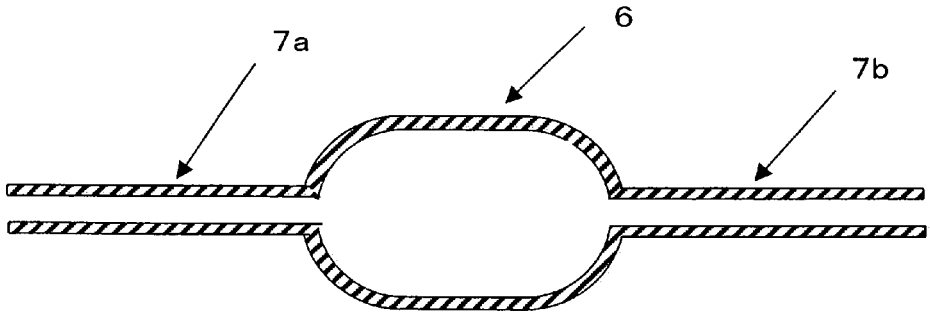
FIG. 9 is a cross-sectional view illustrating the shape of an alternative arc tube that can be used effectively in a metal halide lamp according to the present invention.

To prevent the second metal halide from entering the liquid phase this way, it is effective to provide the tapered portions, in which the inside diameter of the main tube 6 decreases monotonically toward the ends, as shown in FIG. 7B. The tapered portions do not have to have a cross section with straight sides but may also have a curved cross section as shown in FIG. 9, for example.

It should be noted that the center portion of the main tube 6, interposed between the two tapered portions, does not have to be cylindrical, either. Even if the inner space defined by the shape of the main tube 6 is substantially ellipsoidal as a whole, the temperature of the main tube 6 just needs to be increased to such a point that the second metal halide does not remain in the main tube 6.

EXAMPLES

The three types of lamps shown in the following Table 1 were made as samples and subjected to a life test.

TABLE 1

| | Model A | Model B | Model C |
|---|---|---|---|
| Arc tube shape | Cylindrical | Tapered | Tapered |
| Dysprosium iodide | 3.0 | 3.0 | 3.0 |
| Thallium iodide | 0.9 | 0.9 | 0.9 |
| Sodium iodide | 1.3 | 1.3 | 1.3 |
| Calcium bromide | 5.0 | — | 5.0 |

Unit: $mg/cm^3$

In Table 1, each of the numerical values ($mg/cm^3$) represents the ratio of the amount (mg) of the additive enclosed to the entire (inner) volume of the main tube 6. In the lamp on Model A shown in Table 1, a cylindrical arc tube with no tapered portions was used. On the other hand, in the lamps on Models B and C, an arc tube including the tapered portions shown in FIG. 4 was used.

In the arc tube of each of these three lamps, not only dysprosium iodide ($DyI_3$) as the first metal halide but also thallium iodide ($TlI_3$) and sodium iodide (NaI) were enclosed for emission purposes. Also, in the lamps on Models A and C, calcium bromide, having a lower vapor pressure than dysprosium iodide, was further enclosed.

These life test lamps were subjected to a life test in a cycle in which the lamps were kept ON for 5.5 hours and then turned OFF for 0.5 hour, using an electronic ballast with a secondary open-circuit voltage of 285 V as a rectangular wave. The results of the life test are shown in the following Table 2:

TABLE 2

| | Model A | Model B | Model C |
|---|---|---|---|
| Arc tube shape | Cylindrical | Tapered | Tapered |
| Dysprosium iodide | 3.0 | 3.0 | 3.0 |
| Thallium iodide | 0.9 | 0.9 | 0.9 |
| Sodium iodide | 1.3 | 1.3 | 1.3 |
| Calcium bromide | 5.0 | — | 5.0 |

Unit: $mg/cm^3$

The results shown in Tables 1 and 2 revealed that the leakage in the sealing portions, caused by the erosion by the first metal halide enclosed, was closely related to the shape of the arc tube and the non-rare-earth halide. More specifically, in Model A, the calcium bromide enclosed condensed mainly at the edges of the main tube, and could not prevent the erosion effectively. On the other hand, in Model B, the vapor pressures of thallium iodide and sodium iodide are higher than that of dysprosium iodide. That is why the amount of the metal halide in the liquid phase that entered the thin tubes was too small to prevent the erosion.

In contrast, in Model C, most of the calcium bromide enclosed did not remain in the liquid phase in the main tube but entered the thin tubes, thus performing the function of checking the reaction between dysprosium iodide and the glass frit.

Next, it will be described how the sealing portion leakage and lamp efficiency change with the amount of calcium bromide enclosed. First, as shown in the following Table 3, lamps on Models D through H, in which mutually different amounts of calcium bromide were enclosed, were tested on sealing portion leakage and lamp efficiency. The results are shown in the following Table 3:

TABLE 3

| | Model D | Model E | Model F | Model G | Model H |
|---|---|---|---|---|---|
| Calcium bromide [$mg/cm^3$] | 0.05 | 2.5 | 5.0 | 7.5 | 10.0 |
| Sealing portion leakage (in 12,000 h) | No | No | No | No | No |
| Lamp efficiency [lm/W](in 100 h) | 93.0 | 92.5 | 91.5 | 90.5 | 88.0 |

It was expected that the greater the amount of calcium bromide enclosed, the more effectively the erosion would be prevented. However, as can be seen from Table 3, when calcium bromide was enclosed too much, the efficiency rather dropped significantly as in the lamp on Model H. To avoid such decrease in lamp efficiency, the amount of calcium bromide enclosed is preferably set to be 7.5 $mg/cm^3$ at most. Conversely, if the amount of calcium bromide enclosed were less than 0.05 $mg/cm^3$, then dysprosium iodide could not be diluted sufficiently and the erosion would not be prevented effectively. That is why the amount of calcium bromide enclosed is preferably set to be at least equal to 0.05 $mg/cm^3$.

Next, a preferred X/N ratio, which is the ratio of the amount (X moles) of the second metal halide enclosed to the amount (N moles) of the first metal halide enclosed, was determined by experiment.

If the second metal halide enclosed is $CaI_2$ or $LaBr_3$ with a relatively high vapor pressure, the X/N ratio preferably falls within the range of $0.5 \leqq (X/N) \leqq 5$ and more preferably falls within the range of $1.2 \leqq (X/N) \leqq 4$.

On the other hand, if the second metal halide enclosed has a lower vapor pressure than $LaBr_3$, the XIN ratio preferably falls within the range of $0.5 \leqq (X/N) \leqq 8$ and more preferably falls within the range of $1.2 \leqq (X/N) \leqq 8$. Even if such a second metal halide with a relatively low vapor pressure were added a lot, the emission would not be affected easily.

Next, a preferred X/N ratio, which is the ratio of the amount (X moles) of the second metal halide enclosed to the amount (N moles) of the first metal halide enclosed, was determined by experiment.

If the second metal halide enclosed is $CaI_2$ or $LaBr_3$ with a relatively high vapor pressure, the X/N ratio preferably falls within the range of $0.5 \leqq (X/N) \leqq 5$ and more preferably falls within the range of $1.2 \leqq (X/N) \leqq 4$.

In the examples described above, dysprosium iodide ($DyI_2$) is used as the first metal halide. Alternatively, a halide of a lanthanoide such as holmium or thulium, a halide of scandium, or a combination thereof may also be used. More specifically, $DyI_3$, $HoI_3$, $TmI_3$, $DyBr_3$, $HoBr_3$ or $TmBr_3$ is preferably used, for example.

Similar effects are also achieved by enclosing a halide of a metal with a low vapor pressure such as strontium, barium, lanthanum, samarium or europium or a combination thereof instead of, or in addition to, calcium bromide ($CaBr_3$) that would prevent the sealing material from being eroded. More specifically, $CaI_2$, $CaBr_2$, $SrI_2$, $SrBr_2$, $BaI_2$, $LaBr_3$, $SmI_2$, $EuI_2$ or $EuBr_2$ is preferably used. Among these halides, bromides are particularly preferred because bromides tend to have lower vapor pressures than iodides as shown in FIG. 6 and can dilute the first metal halide effectively when entering the liquid phase.

It should be noted that bromides and iodides of Ca have relatively high vapor pressures among the metal halides of the second type and tend to vaporize partially and contribute to electrical discharge. However, Ca has a property of improving the color of the emission caused by the electrical discharge. Accordingly, if extension of lamp life and improvement of the color of light should be realized at the same time, particularly beneficial effects are achieved by adding a halide of calcium among various metal halides of the second type. If a calcium halide needs to be partially vaporized intentionally to contribute to the electrical discharge more effectively, then calcium iodide, having a higher vapor pressure than calcium bromide, is preferably used.

In the preferred embodiments and examples of the present invention described above, the entire arc tube, including the thin tubes, is provided inside of the outer tube (i.e., the light-transmitting protective cylinder). In this case, the temperature at the sealing portions of the thin tubes will never be significantly lower than any other portion. Thus, the second metal halide in the liquid phase is likely to disperse in the thin tubes here and there. On the other hand, if the sealing portions of the thin tubes were exposed outside of the protective cylinder, then the temperature at the exposed portions would drop and most of the second metal halide would easily condense on the surface of the sealing portions. When such condensation happens, the erosion of the sealing portions can be prevented even more effectively.

The effect of getting the erosion of the sealing material by the first metal halide minimized by the second metal halide was confirmed where the lamp power was in the range of 70 W to 400 W.

According to the present invention, by enclosing a second metal halide, having a sufficiently low vapor pressure at the temperature at the sealing portions while the lamp is ON, into an arc tube including tapered portions at both ends, the erosion of the sealing material by a first metal halide, which will cause leakage in the sealing portions, can be minimized. Thus, the present invention provides a metal halide lamp that will cause no leakage in the sealing portions for a long time.

The invention claimed is:

1. A metal halide lamp comprising an arc tube and a first metal halide that is enclosed in the arc tube, wherein the first metal halide is a halide of at least one metal selected from the group consisting of dysprosium, holmium and thulium, and wherein the arc tube includes:

a main tube made of a light-transmitting ceramic;

a first thin tube coupled to a first end of the main tube;

a second thin tube coupled to a second end of the main tube; and a pair of electrode leads, which are inserted into the first and second thin tubes, respectively, such that the far ends of the leads face each other inside the main tube, and wherein the respective ends of the first and second thin tubes are sealed with a sealing material, and wherein at least a portion of the surface of the sealing material communicates with the inside of the main tube through a gap created between the inner wall of the thin tubes and the surface of the electrode leads, and wherein a second metal halide, which has a lower vapor pressure than that of the first metal halide at a temperature at sealing portions while the lamp is ON, is enclosed in the arc tube, and wherein the second metal halide is a halide of at least one metal selected from the group consisting of calcium, strontium, barium, lanthanum, samarium and europium;

wherein the arc tube has portions of which the inside diameter decreases monotonically toward the ends, wherein the sealing portions are made of a material including $SiO_2$, and wherein the second metal halide in a liquid phase is present on a surface of the sealing material and the first metal halide is diluted on the surface of the sealing material.

2. The metal halide lamp of claim 1, wherein the vapor pressure of the second metal halide is one-tenth or less of that of the first metal halide.

3. The metal halide lamp of claim 2, wherein the sealing material is made of glass.

4. The metal halide lamp of claim 1, wherein the second metal halide is a metal bromide.

5. The metal halide lamp of claim 1, wherein the amount of the second metal halide enclosed falls within the range of 0.05 $mg/cm^3$ to 7.5 $mg/cm^3$.

6. The metal halide lamp of claim 1, wherein the ratio of the amount of the second metal halide enclosed to that of the first metal halide enclosed is represented by a mole fraction of 0.5 to 8.

7. The metal halide lamp of claim 1, wherein the light-transmitting ceramic is alumina.

8. The metal halide lamp of claim 1, wherein the arc tube and the first and second thin tubes have been molded together.

9. The metal halide lamp of claim 8, wherein the arc tube has a hollow ellipsoidal shape.

10. The metal halide lamp of claim 1, further comprising an outer tube to include the arc tube in its inner space, and a light-transmitting protective cylinder for housing the arc tube in the inner space of the outer tube, wherein the thin tubes are partially exposed outside of the protective cylinder.

11. A lamp module comprising the metal halide lamp of claim 1, and a reflective mirror for projecting light, radiated from the metal halide lamp, in a predetermined direction.

12. A display device comprising:

the metal halide lamp of claim 1, and a display panel for presenting an image thereon by modulating the light, radiated from the metal halide lamp, both temporally and spatially.

13. The metal halide lamp of claim 1, wherein mercury is enclosed in the arc tube.

14. The metal halide lamp of claim 1, wherein the sealing portions are made of $SiO_2$ that is erodible by the first metal halide reaching through the gap between the inner wall of the thin tubes and the surface of the electrode leads.

* * * * *

UNITED STATES PATENT AND TRADEMARK OFFICE

CERTIFICATE OF CORRECTION

PATENT NO. : 7,679,290 B2
APPLICATION NO. : 11/291628
DATED : March 16, 2010
INVENTOR(S) : Atsushi Utsubo et al.

It is certified that error appears in the above-identified patent and that said Letters Patent is hereby corrected as shown below:

On the Title Page, the following should appear:

Related U.S. Application Data

Item (63) Continuation of Application No. PCT/JP2004/005652 filed on Apr. 20, 2004.

Signed and Sealed this

Eighteenth Day of May, 2010

David J. Kappos

David J. Kappos
*Director of the United States Patent and Trademark Office*